US008118623B2

(12) United States Patent
Tung et al.

(10) Patent No.: US 8,118,623 B2
(45) Date of Patent: Feb. 21, 2012

(54) ELECTRICAL CONTACT HAVING FOLDED CONTACTING PORTION

(75) Inventors: Chang-Hsien Tung, Tu-Cheng (TW); Hung-Chi Yu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/823,125

(22) Filed: Jun. 25, 2010

(65) Prior Publication Data

US 2010/0330852 A1 Dec. 30, 2010

(30) Foreign Application Priority Data

Jun. 25, 2009 (TW) ..... 98121412 A

(51) Int. Cl.
*H01R 13/92* (2006.01)

(52) U.S. Cl. ..... 439/884

(58) Field of Classification Search ..... 439/884, 439/881, 825, 841, 845, 850
See application file for complete search history.

(56) References Cited

U.S. PATENT DOCUMENTS 4,618,209 A * 10/1986 Sonobe ..... 439/395
6,000,973 A * 12/1999 Mitra ..... 439/825
6,086,403 A 7/2000 Po et al.
6,402,566 B1 * 6/2002 Middlehurst et al. ..... 439/699.1

FOREIGN PATENT DOCUMENTS

TW 539270 6/2003

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical contact made from a metal sheet includes a contacting portion for mating with a mating contact, a terminal portion for connecting with a printed circuit board and a retaining portion connecting the contacting portion and the terminal portion. The contacting portion defines first and second contacting pieces made from the metal sheet and folded to abut against each other, and the terminal portion extends from one of the contacting pieces, which can reduced the cost of the electrical contact.

16 Claims, 3 Drawing Sheets

ELECTRICAL CONTACT HAVING FOLDED CONTACTING PORTION

BACKGROUND OF THE INVENTION

1. Field of the Invention

The present invention relates to an electrical contact, and more particular to an electrical contact with the contacting portion formed of two-level layers type by folding up a metal sheet for reducing the cost on base to ensure strength and rigidity of the contacting portion.

2. Description of the Related Art

Electrical contact defining blade portion is widely used for power transmission in battery connectors, and U.S. Pat. No. 6,086,403 issued to Po et al. on Jul. 11, 2000 and Taiwan Patent Issued Number 539270 issued to Chen on Jun. 21, 2003 each discloses a battery connector illustrating such a conventional electrical contact thereof. The electrical contact is punched or cut out from a comparably thick board-shaped metal sheet, and the soldering portion has a same thickness as that of the contacting portion. The thick soldering portion uses a lot of metal sheet and will increase the cost of the electrical contact. Obviously, an improved electrical contact which can reduce the cost is highly desired.

SUMMARY OF THE INVENTION

Accordingly, an object of the present invention is to provide an electrical contact with simplified manufacture and low cost.

In order to achieve the object set forth, an electrical contact made from a metal sheet includes a contacting portion for mating with a mating contact, a terminal portion for connecting with a printed circuit board and a retaining portion connecting the contacting portion and the terminal portion. The contacting portion defines first and second contacting pieces made from the metal sheet and folded to abut against each other, and the terminal portion extends from one of the contacting pieces.

Other objects, advantages and novel features of the invention will become more apparent from the following detailed description of the present embodiment when taken in conjunction with the accompanying drawings.

DETAILED DESCRIPTION OF THE INVENTION

Figure 1:
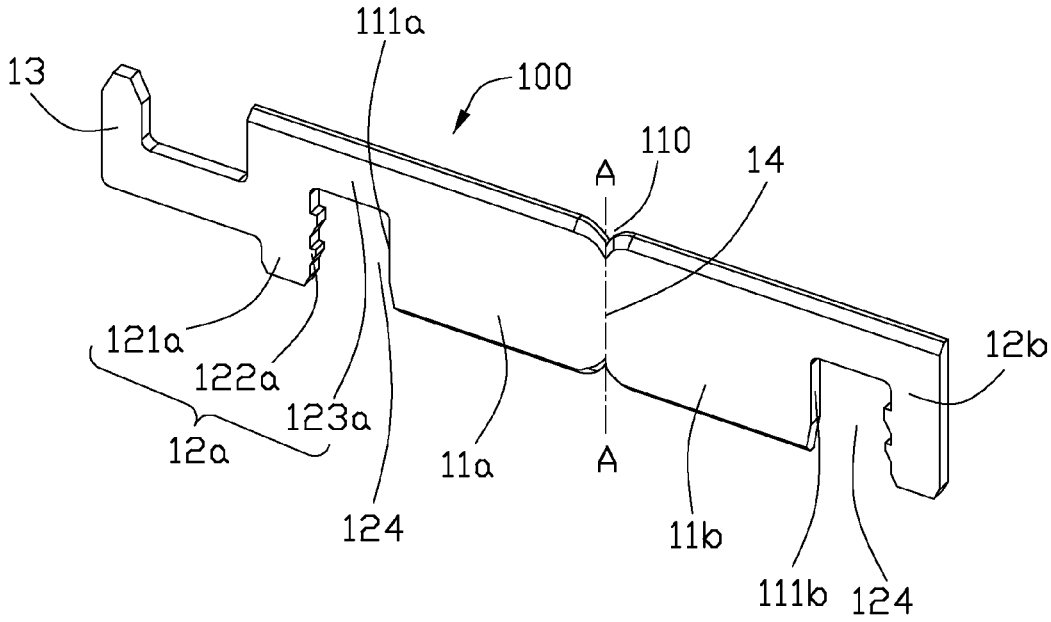
FIG. 1 is a perspective view of a metal sheet before folded to be an electrical contact.

Reference will now be made to the drawing figures to describe preferred embodiments of the present invention in detail.

Figure 2:
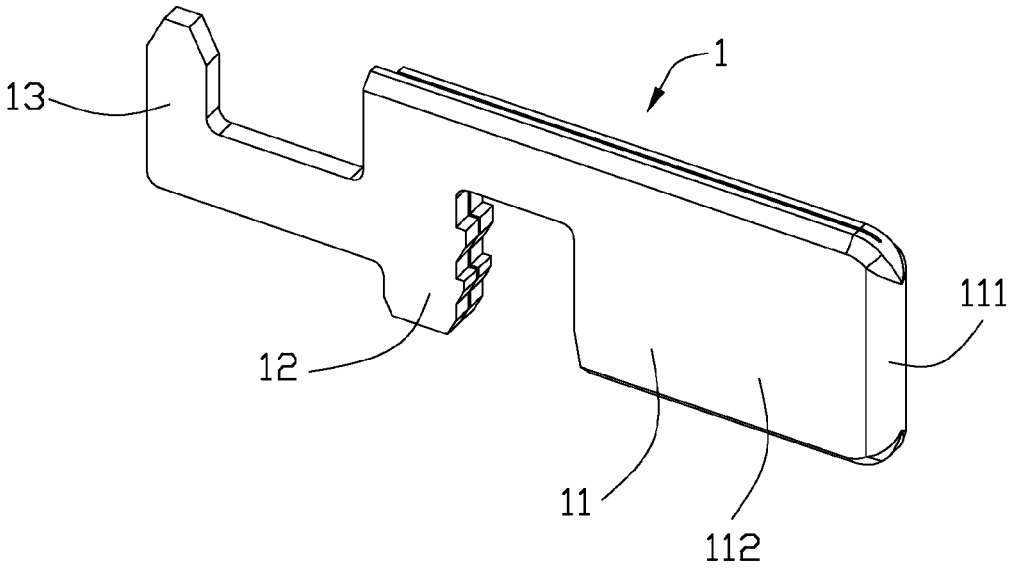
FIG. 2 is a perspective view of an electrical contact folded from the metal sheet shown in FIG. 1.

Referring to FIG. 1 and FIG. 2, disclosed here is an electrical contact 1 made in accordance with the present invention. The electrical contact 1 made from a metal sheet 100 which defines 0.25-0.3 mm thickness. The metal sheet 100 is punched or cut out to defines a first contacting piece 11*a* and a second contacting piece 11*b* connecting with the first connecting piece 11*a*. A connecting portion 14 extending along a line A-A is provided at a joint of the first and second contacting pieces 11*a*, 11*b*. The first and second contacting pieces

11*a*, 11*b* are disposed in a same plane as the metal piece 100, and a pair of indentations 110 is respectively provided at upper and lower side edges of the joint of the first and second contacting pieces 11*a*, 11*b*. The first contacting piece 11*a* defines a first retaining piece 12*a* extending from a side edge 111*a* opposite to the connecting portion 14, and the first retaining piece 12*a* defines a first vertical piece 121*a* spaced from the first contacting piece 11*a* and with barbs facing to the side edge 111*a*, and a first connecting piece 123*a* extending horizontally from an upper portion of the side edge 111*a* to connect the first contacting piece 11*a* and the first vertical piece 121*a*. An opening 124 facing downwards is formed between the first contacting piece 11*a* and the first retaining piece 12*a*, and the barbs 122*a* are disposed in the opening 124. An L-shaped terminal piece 13 which extends horizontally and then upwards from a side edge of the first vertical piece 121*a* is used for connecting with a printed circuit board.

The second contacting piece 11*b* defines a second retaining piece 12*b* extending horizontally and then downwards from a side edge 111*b* opposite to the connecting portion 14. The second retaining piece 12*b* has a same configuration as the first retaining piece 12*a* except that there is no terminal piece extending from the second retaining piece 12*b*. The first contacting piece 11*a* is of a mirror image with regard to the second contacting piece 11*b*, and the first retaining piece 12*a* is of a mirror image with regard to the second retaining piece 12*b*.

Figure 3:
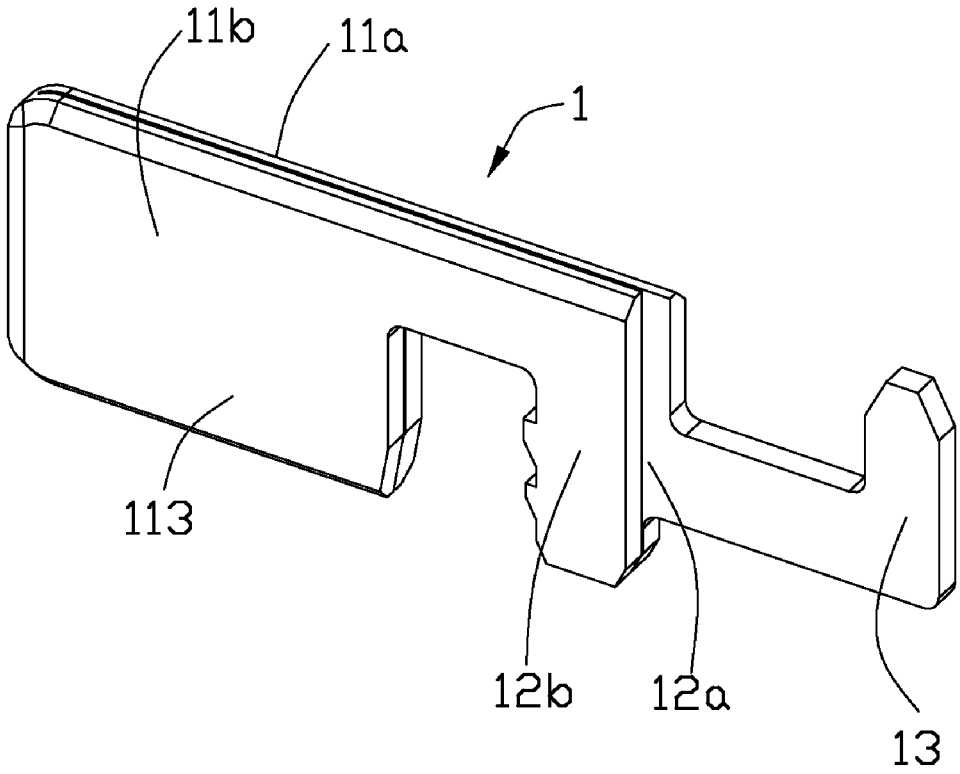
FIG. 3 is another perspective view of the electrical contact shown in FIG. 2.

Referring to FIG. 1 to FIG. 3, the metal sheet 100 can be folded along the line A-A to make the first and second contacting pieces 11*a*, 11*b* attaching to each other, synchronously, the first and second retaining piece 12*a*, 12*b* attaching to each other, and an electrical contact 1 thereof is provided. The first and second contacting pieces 11*a*, 11*b* abut against each other to provide a contacting portion 11 of the electrical contact 1, the first and second retaining pieces 12*a*, 12*b* abut against each other to define a retaining portion 12 of the electrical contact 1, and the terminal piece 13 extending from the first retaining piece 12*a* is defined as a terminal portion of the electrical contact 1. The contacting portion 11 and the retaining portion 12 both are formed of two-level type by folding up the metal sheet 100, and the terminal piece 13 is formed from one metal piece extending from the first retaining piece 12*a*. Opposite surfaces 112, 113 of the contacting portion 11 can be contacted by a mating contact. The connecting portion 14 is folded to be provided as a front mating edge 111 of the electrical contact 1, and at least the upper side edge of the contacting portion 11 defines guiding faces thereof for guiding a mating contact.

The contacting portion 11 folded by the first and second contacting pieces 11*a*, 11*b* has double thickness as that of the metal sheet 100 and is provided with a thickness similar to a conventional contact of a battery connector, which is strong enough for mating with a mating contact in a normal state. The electrical contact 1 does not include a second terminal piece extending from the second retaining piece 12*b* and provides only one terminal piece 13 extending from the first retaining piece 12*a* as a terminal portion of the electrical contact 1, which can save the material that is to form the second terminal piece. Moreover, the cost of the electrical contact 1 can be reduced effectively. In other embodiment, the electrical contact 1 also can omit the first terminal piece 13 and set the terminal portion defined as a second terminal piece extending from the second retaining piece 12*b*. A plurality of electrical contacts 1 can be retained to an insulative housing for providing an electrical connector, especially for providing a battery connector, and the second retaining piece 12*b* can be inserted into the housing to prevent the mating contact from being scraped by the side edge 111*b* of the second contacting piece 11*b*. In other embodiment, the second retaining piece 12*b* also can be omitted, and more material of the metal sheet 100 can be saved, and the cost of the electrical contact can be further reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical contact made from a metal sheet, comprising:

a contacting portion for mating with a mating contact;

a terminal portion for connecting with a printed circuit board; and a retaining portion connecting the contacting portion and the terminal portion;

wherein the contacting portion defines first and second planar contacting pieces made from the metal sheet and folded to abut against each other in an intimate face-to-face manner, the retaining portion defines first and second retaining pieces stacked with each other, and the first retaining piece extends from the first planar contacting piece and the second retaining piece extends from the second planar contacting pieces, and the terminal portion connects with one of the retaining pieces.

2. The electrical contact as described in claim 1, wherein a connecting portion disposed at a joint of the first and second contacting pieces is provided as a front mating edge of the contacting portion, and the first retaining piece extends from a side edge of the first contacting piece which is opposite to the front mating edge, and the second retaining piece extends from a side edge of the second contacting piece which is opposite to the front mating edge.

3. The electrical contact as described in claim 2, wherein the retaining portion defines a vertical portion spaced from the contacting portion and with barbs projecting to the contacting portion, and a connecting portion extending from the contacting portion to connect the contacting portion with the vertical portion.

4. The electrical contact as described in claim 3, wherein the terminal portion extends from a side edge of the vertical portion, and the terminal portion and the barbs are respectively disposed at two opposite side edges of the vertical portion.

5. The electrical contact as described in claim 4, wherein the terminal portion extends horizontally and then upwards to define an L shape.

6. A metal sheet for making an electrical contact therefrom, comprising:

a first contacting piece;

a second contacting piece connected with the first contacting piece and providing a connecting portion at a joint thereof;

a first retaining piece extending away from the connecting portion from a side edge of the first contacting piece opposite to the connecting portion;

a second retaining piece extending away from the connecting portion from a side edge of the second contacting piece opposite to the connecting portion; and a first terminal piece extending from the first retaining piece for connecting with a printed circuit board; wherein there is no terminal piece extending from the second retaining piece, wherein the first retaining piece defines a vertical piece spaced from the first contacting piece and with barbs projecting to the first contacting piece, and a connecting piece extending from the first contacting piece to connect the first contacting piece with the vertical piece.

7. The metal sheet as described in claim 6, wherein the first and second contacting pieces are folded along the connecting portion to abut against each other to define a contacting portion of the electrical contact for mating with a mating contact.

8. The metal sheet as described in claim 6, wherein the first terminal piece is defined as a terminal portion of the electrical contact.

9. The metal sheet as described in claim 6, wherein the first terminal piece extends from a side edge of the first vertical piece.

10. The metal sheet as described in claim 6, wherein the second contacting piece is of a mirror image with regard to the first contacting piece, and the second retaining piece is of a mirror image with regard to the first retaining piece.

11. An electrical contact comprising:

a first planar part and second planar part mostly stacked with each other in an intimate face-to-face manner; wherein only one of said first planar part and said second planar part includes a terminal portion for mounting to a printed circuit board while both of said first planar part and said second planar part include corresponding contacting portions intimately stacked together with a joint sharing a common edge thereof, wherein both of the first planar part and the second planar part define corresponding retaining portions linked behind the corresponding contacting portions, respectively.

12. The electrical contact as claimed in claim 11, wherein said common edge is a front edge.

13. The electrical contact as claimed in claim 11, wherein said retaining portions of the first planar part and of the second planar part are intimately stacked with each other sharing a same configuration.

14. The electrical contact as claimed in claim 13, wherein each of said retaining portions defines a notch at a same position.

15. The electrical contact as claimed in claim 14, wherein each notch is equipped with barbs on an edge thereof.

16. The electrical contact as claimed in claim 11, wherein the contacting portions of said first planar part and of the second planar part share a same configuration.

* * * * *